US010151175B2

(12) United States Patent
Booker et al.

(10) Patent No.: US 10,151,175 B2
(45) Date of Patent: Dec. 11, 2018

(54) REMOTE DOWNHOLE ACTUATION DEVICE

(71) Applicant: Schlumberger Technology Corporation, Sugar Land, TX (US)

(72) Inventors: John A. Booker, Missouri City, TX (US); Eugene Janssen, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 545 days.

(21) Appl. No.: 14/435,757

(22) PCT Filed: Oct. 15, 2013

(86) PCT No.: PCT/US2013/064899
§ 371 (c)(1),
(2) Date: Apr. 15, 2015

(87) PCT Pub. No.: WO2014/062593
PCT Pub. Date: Apr. 24, 2014

(65) Prior Publication Data

US 2015/0260013 A1 Sep. 17, 2015

Related U.S. Application Data

(60) Provisional application No. 61/713,743, filed on Oct. 15, 2012.

(51) Int. Cl.
*E21B 34/14* (2006.01)
*E21B 34/06* (2006.01)

(52) U.S. Cl.
CPC ..... *E21B 34/14* (2013.01); *E21B 34/066* (2013.01)

(58) Field of Classification Search
CPC ..... E21B 34/14; E21B 34/066; E21B 47/09; E21B 47/0905; E21B 47/122; E21B 23/01; E21B 23/02
See application file for complete search history.

(56) References Cited

U.S. PATENT DOCUMENTS

| | | | | |
|---|---|---|---|---|
| 6,084,403 | A | 7/2000 | Sinclair et al. | |
| 6,333,700 | B1 * | 12/2001 | Thomeer | E21B 23/00 166/254.2 |
| 7,322,417 | B2 | 1/2008 | Rytlewski et al. | |
| 7,325,616 | B2 | 2/2008 | Lopez de Cardenas et al. | |
| 7,377,321 | B2 | 5/2008 | Rytlewski | |
| 7,387,165 | B2 | 6/2008 | Lopez de Cardenas et al. | |

(Continued)

FOREIGN PATENT DOCUMENTS

| | | |
|---|---|---|
| WO | 2012045165 A1 | 6/2010 |
| WO | 2012045165 A1 | 4/2012 |

OTHER PUBLICATIONS

International Search Report and Written Opinion dated Jan. 24, 2014, for PCT/US2013/064899, filed on Oct. 15, 2013.

*Primary Examiner* — Jennifer H Gay

(57) ABSTRACT

A remotely deployed untethered device for actuation of a downhole application. The device may be equipped with inductive measurement capacity for interaction with a downhole well architecture. Such capacity affords the ability to trigger an actuation remotely at a site specific location in the well without further intervention relative surface equipment.

19 Claims, 5 Drawing Sheets

(56) References Cited

U.S. PATENT DOCUMENTS

| | | | | |
|---|---|---|---|---|
| 7,909,108 | B2 * | 3/2011 | Swor | E21B 43/14 166/383 |
| 9,631,470 | B2 * | 4/2017 | Orban | E21B 43/263 |
| 9,650,851 | B2 * | 5/2017 | Whitsitt | E21B 23/00 |
| 2011/0037004 | A1 | 2/2011 | Lake et al. | |
| 2011/0056692 | A1 | 3/2011 | Lopez De Cardenas et al. | |
| 2011/0284240 | A1 | 11/2011 | Chen et al. | |
| 2012/0085538 | A1 * | 4/2012 | Guerrero | E21B 33/12 166/284 |
| 2013/0206402 | A1 * | 8/2013 | Coon | E21B 23/08 166/255.1 |
| 2014/0076542 | A1 * | 3/2014 | Whitsitt | E21B 34/14 166/250.1 |
| 2015/0060064 | A1 * | 3/2015 | Lafferty | E21B 34/14 166/280.1 |
| 2015/0260013 | A1 * | 9/2015 | Booker | E21B 34/14 166/250.01 |
| 2015/0361747 | A1 * | 12/2015 | Lafferty | E21B 34/14 166/373 |
| 2015/0361761 | A1 * | 12/2015 | Lafferty | E21B 23/14 166/250.01 |
| 2016/0084075 | A1 * | 3/2016 | Ingraham | E21B 23/10 166/255.1 |
| 2016/0108722 | A1 * | 4/2016 | Whitsitt | E21B 34/14 166/254.1 |
| 2017/0009563 | A1 * | 1/2017 | Holder | E21B 43/263 |

* cited by examiner

REMOTE DOWNHOLE ACTUATION DEVICE

BACKGROUND

Exploring, drilling and completing hydrocarbon and other wells are generally complicated, time consuming, and ultimately very expensive endeavors. As a result, well completions and architecture design are directed at enhancing overall recovery. In particular, efforts have increased related to minimizing all costly and time consuming endeavors related to installation and subsequent interventional management. For example, over the course of well completions and later management a host of interventions may be performed ranging from installation of hardware, detection of well conditions, follow-on isolations, shifting of sliding sleeves, and so on. Many of these interventions are equipment-heavy, time consuming and invasive operations. In the case of sliding sleeves, such as to open up a new region of production, ongoing operations are halted and a shifting tool inserted up to several thousand feet into the well for the sake of opening the sleeve.

Dedicated interventions of this nature are not only time consuming, but generally include a substantial amount of rig-up equipment at the oilfield surface. For example, coiled tubing or other conveyance equipment utilized for the shifting application is set up and broken back down again before production operations are resumed. Thus, the overall time lost and cost associated with an otherwise fairly straight forward sleeve shifting, becomes discouraging.

DETAILED DESCRIPTION

Figure 1:
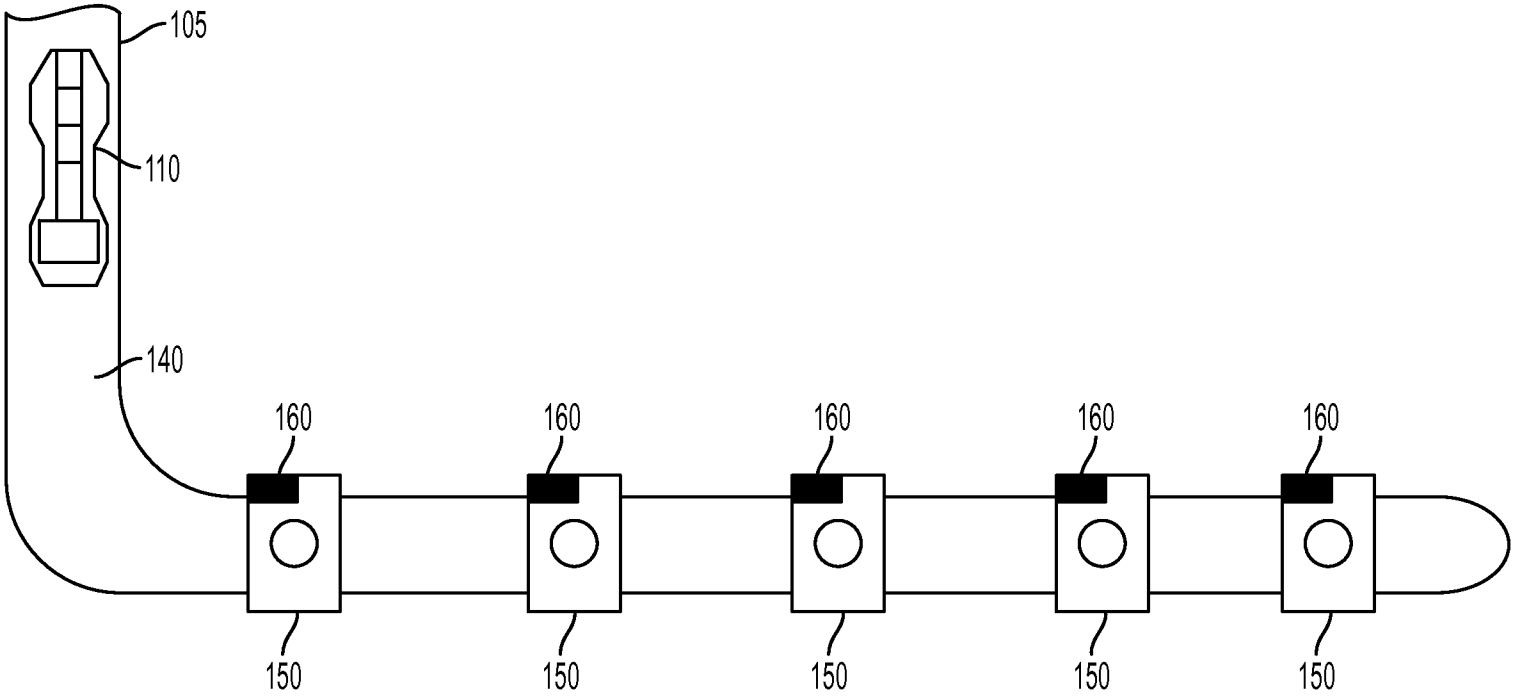
FIG. 1 is a schematic overview of a remote downhole actuation device traversing well in advance of reaching a series of potential triggering engagements.

A device is described for use in triggering downhole actuations. In one embodiment, the device may take the form of a remote actuation device that includes a main body configured for untethered deployment through a well. An inductive measurement device that is able to identify specific features of the well may be incorporated into the body for the triggering at a location in the well during the deployment.

Some example embodiments described herein include certain types of remote actuations directed from surface via an untethered device. The embodiments make use of a remote actuation device deployable through a well for selective triggering of sliding sleeves at a well wall. However, a variety of other actuations and/or operations may implement the remote actuation device as detailed herein. Some embodiments include an untethered configuration relative to an oilfield surface in combination with inductive capacity built into the device for triggering a remote actuation as the device traverses past an actuation site.

One embodiment may take the form of a multi-zone fracturing system in which a number of sliding sleeves are run during the completion of a reservoir. The sliding sleeves are positioned at determined intervals corresponding to fracture zones. The embodiment may include a method for identifying the sliding sleeves. In particular, the sliding sleeves may be identified by a device that is moving past the sliding sleeves in the wellbore, typically at an unknown velocity. The identification of the sliding sleeves may be used as a trigger for downhole actuation of the device. In some embodiments, the actuation may be autonomous.

Some embodiments may include an autonomous dart that is pumped down the wellbore. Once the autonomous dart identifies a selected sliding sleeve, either by counting the number of sleeves passed or identifying a unique signature of the selected sleeve, the dart is actuated. The actuation of the dart may include at least one of a variety of suitable state changes. In one embodiment, the actuation may include a radial expansion of an outer diameter of the dart so that it engages an interior wall of the well bore, a tubular or a sliding sleeve, for example.

The identification of the sliding sleeves includes changes in electro-magnetic coupling or inductive coupling between transmitting and receiving coils in the dart due to the differences in attributes in the wellbore and/or of downhole device (e.g., the sliding sleeves). These attributes include, but are not limited to, the geometry and material of the device being identified. By measuring the changes in electro-magnetic coupling a unique signature of the device can be generated. This signature can be a result of either the response of the unmodified device or the response to specific features added to the device being identified. For example, grooves on the inner diameter or outer diameter of the device may be used to intentionally generate a response or signature that can be recognized.

In some embodiments, the sliding sleeves are interrogated by a device. The device may be a balanced coil that is sensitive to changes in the metal and shape of the sliding sleeve. In addition, grooves may be added to the inner diameter of the sliding sleeve so the balanced coil will generate a unique signature that will distinguish the sliding sleeve from the other equipment installed in the wellbore.

A series of sliding sleeves are run in the wellbore as part of the casing string upon completion of an oil or gas reservoir. After completion of the reservoir, the decision is made on which sliding sleeve(s) is opened to allow hydraulic communication between the inside of the casing and the formation in the fracture zone(s) of interest. The sliding sleeve is opened by pumping an element or dart down the wellbore that can identify the sliding sleeves. The dart measures the unique signature using a balanced coil based sensing system and when it detects the sleeve of interest, either by counting the sleeves as if flows past them or by identifying a sleeve using a unique signature, the dart will initiate an action(s). In this application, the action is enabling a mechanism to open the sliding sleeve of interest. The dart was programmed at the surface on what sliding sleeve to open.

A mechanism for identifying a wellbore element can have many other applications in the downhole environment. For example, whenever selective activation or selective communication with one or a series of devices is desired, embodiments as detailed herein may be utilized.

Turning to the drawings and referring initially to FIG. 1, a remote actuation device 110 is shown traversing a well 105 in advance of reaching a series of potential triggering engagements 160. The triggering engagements 160 may take any suitable form, as discussed further herein below. For the present example, a wellbore 140 with multiple sliding sleeves 120 having triggering engagements 160 installed is depicted with a sensing dart (e.g., the remote actuation device) 110 being pumped from the surface. The wellbore 140 may traverse one or more formations (hydrocarbon bearing formations, for example). In general, the wellbore 140 may extend through one or multiple zones or stages of the well 105.

The remote actuation device 110 may generally take the form of an untethered object (e.g., an object that travels at least some distance in a well passageway without being attached to a conveyance mechanism such as a slickline, wireline, coiled tubing sting and so forth). As specific examples, the untethered object may be a dart, a ball or a bar. However, it should be appreciated that the remote actuation device 110 may take any suitable form that may be pumped into the well 105, although pumping may not be employed to move the device in the well, in accordance with further implementations.

Figure 2:
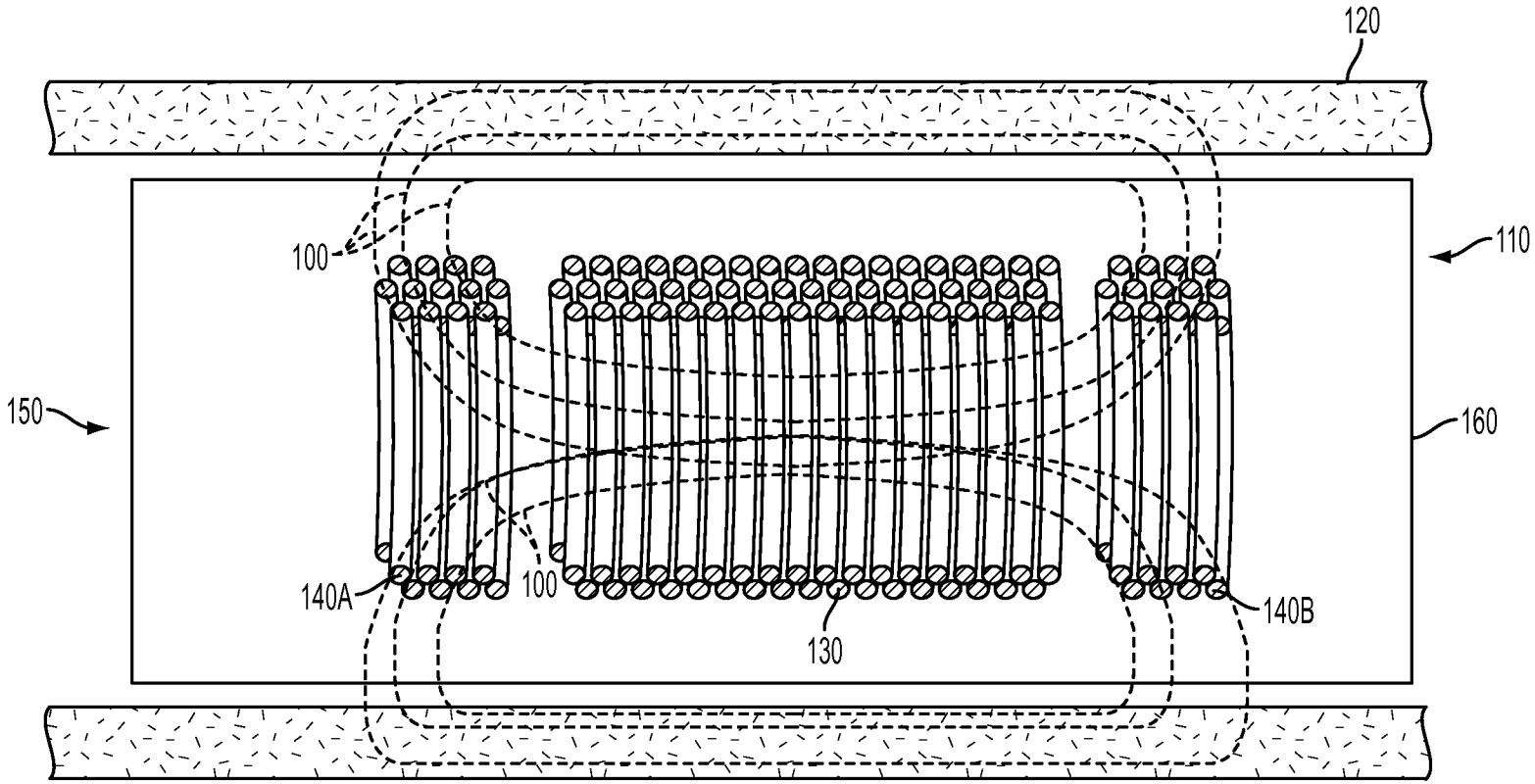
FIG. 2 is a schematic view of an embodiment of the remote sensor element of the downhole actuation device passing through a portion of the well of FIG. 1 and performing inductive measurements.

Turning to FIG. 2 magnetic flux lines 100 of a sensor element 200 of the remote actuation device 110, are depicted relative to a sliding sleeve 120. More specifically, FIG. 2 is a schematic view of an embodiment of a remote downhole actuation device 110 passing through a portion of a well and taking inductive measurements. It should be appreciated, that although the present examples are presented with reference to inductive or electro-magnetic coupling, other parameters may be measured such as conductance, impedance, capacitance, and so forth.

In the illustrated embodiment, the remote actuation device 110 includes multiple coils. Specifically, the remote actuation device 110 includes a transmission coil 130, and two receiver coils 140. The two receiver coils 140 may be disposed on either side of the transmission coil 130. That is, one receiver coil 140A may be disposed on an uphole side 150 of the transmission coil 130 and the other receiver coil 140B may be disposed on a downhole side 160 of the transmission coil. Each of the coils may be formed by winding a conductor, such as copper wire about a spool. The coils may be wound about a common spool or separate spools. It should be appreciated that some embodiments may include more or fewer coils. For example, one embodiment may include two coils, while another may include only the transmission coil 130. That is, in one embodiment, a single coil may be implemented as an inductive sensor to sense changes in a coupling between the coil and the casing or sliding sleeve as the sensor passes therethrough.

As illustrated, in some embodiments, the transmission coil 130 may include more windings than the receiver coils 140. Additionally, the transmission coil 130 may be coupled to a power source, such as a battery, for example, so that an electrical current flows through the transmission coils to create the magnetic flux lines 100. As such, the remote actuation device 110 may take the form of an active device. In other embodiments, the remote actuation device 110 may take the form of a passive device (e.g., one in which no battery or power is provided to the coils).

The remote actuation device 110 may be configured to sense changes in a coupling between the coils 130, 140 as the remote actuation device moves in proximity to elements that influence the magnetic flux lines 100. For example, as the remote actuation device 110 travels downhole, the magnetic flux lines may be altered by changes in a sliding sleeve and, thereby, changing the coupling between the transmission coil 130 and the receiver coils 140. For example, notches or recesses on the interior or exterior of the sliding sleeve may be sensed, as well as protrusions, as the magnetic flux lines will be influenced by the different features. An on-board processor may process information gathered by the sensor and determine if a set criteria has been met to trigger and actuation.

The operating frequency of the signal transmitted between the coils can be varied in order to change the depth of penetration into the metal to eliminate features of no interest. For example by increasing the frequency, the casing couplings that are located outside the casing will not be detected or produce unwanted responses.

Figure 3:
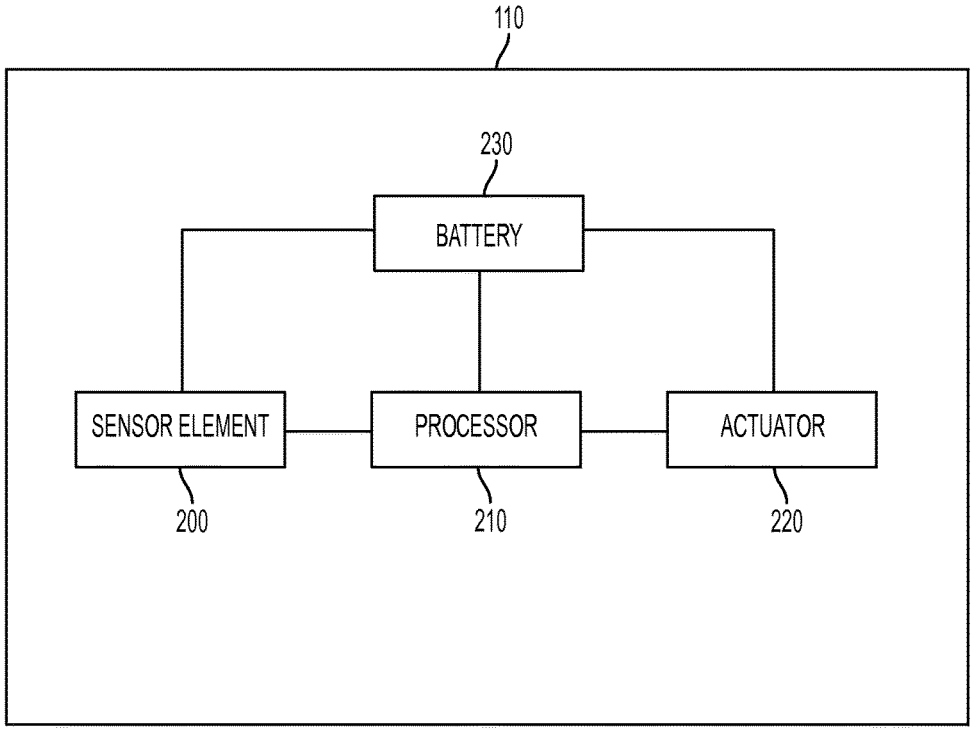
FIG. 3 is a block diagram of the downhole actuation device of FIG. 1.

FIG. 3 is a block diagram of the remote actuation device 110. The remote actuation device 110 may include a sensor element 200, which may take the form of the inductive sensor with the coils 130, 140 described above or any other suitable sensor device, a processor 210 communicatively coupled to the sensor element, and an actuator 220 communicatively coupled to processor. A battery 230 may be provided to power the sensor element 200, the processor 210 and the actuator 220. As such, the battery 230 may be coupled to each of the noted devices.

Generally, the processor 210 may take any suitable form and, in some embodiments, may take the form of a controller, an application specific integrated circuit (ASIC), a field programmable gate array (FPGA), a CPU, or other suitable processing device. In some embodiments, the processor 210 may take the form of a counting circuit that keeps track of a number of changes in the magnetic flux lines. In particular, a count may increase upon a change in the magnetic flux lines that exceeds a determined threshold (e.g., a threshold voltage or voltage change produced by the receiving coils) as the remote actuation device 110 travels downhole. In other embodiments, the processor 210 may have on-board memory which may store particular patterns or signatures that may be used as reference to determine if a sensed change in a magnetic flux should trigger an actuation. In some embodiments, the processor 210 may be configured to determine if a particular change in magnetic flux lines should register a count. In other embodiments, rather than depending upon keeping count, the processor 210 may be configured to determine if a determined triggering signature has been found.

Upon reaching a desired count, or finding the determined triggering signature, the processor 210 may trigger the actuator 220 to actuate. In some embodiments, actuation of the actuator 220 may result in the stopping of the remote actuation device 110 in the casing. For example, a portion of the remote actuation device 110 may radially expand and engage an interior wall of the casing. An operation may be performed while the remote actuation device 110 is stopped within the casing creating a diversion or stoppage. In one embodiment, a shifting sleeve may be shifted. In another embodiment, a fracing operation may be performed.

Figure 4:
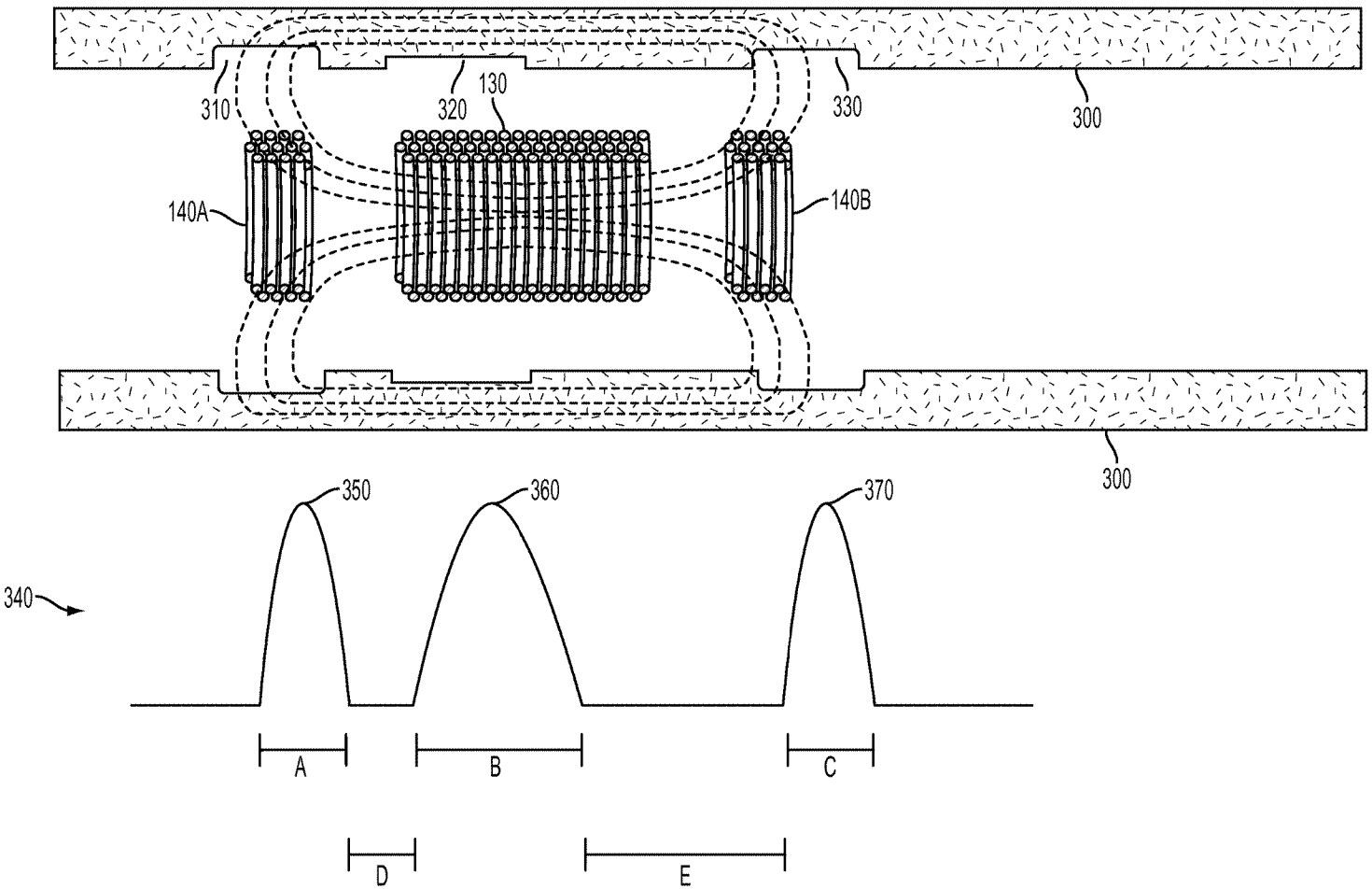
FIG. 4 illustrates the sensor element of the remote actuation device of FIG. 1 within a sleeve having notches therein to influence the magnetic flux lines and an inductive signature generated by the sensor element due to the notches.

FIG. 4 illustrates the sensor element 200 of the remote actuation device of FIG. 1 within a portion of a sleeve 300 having attributes to change the magnetic flux lines 100 of the sensor element. Specifically, the sleeve 300 includes notches 310, 320, 330 to influence the magnetic flux lines 100 and generate an inductive signature. Generally, the remote actuation device 110 traveling through the sliding sleeve 300 while transmitting from the transmission coil 130 to the two receiver coils 140 will generate a signature response based on the dimensions of the notches 310, 320, 330. The signature or measured response will change based on the change in coupling between the coils caused by attribute changes in the sliding sleeve. Further, the signature may deviate more than a threshold amount from an average steady state of the magnetic flux lines 100 of the sensor element 200 as the device 110 travels through the wellbore 140.

The notches or grooves 310, 320, 330 have been added to the inner diameter of sleeve 300, but in other embodiments, the notches may be formed on an outer diameter of the sleeve. Additionally, a protrusion may extend from the sleeve and influence the magnetic flux lines. In the illustrated example, the notches 310, 320, 330 influence the magnetic flux lines in a manner that results in a pre-established signature unique to the sliding sleeve for reliably identifying the sliding sleeve. It should be appreciated that the size and spacing of the notches, as well as other attributes, each may influence the magnetic flux lines and, hence, help create the unique signature for the sleeve.

An example signature 340 is illustrated in FIG. 4. The example signature 340 includes three distinct peaks 350, 360, 370, each with a width A, B, C and a relative spacing D, E between the peaks. Each of the various features of the signature 340 may be used alone or in combination with other features for determining if a particular marker has been passed and/or for identifying a device. Additionally, the unique signature can be modified to increase the uniqueness with the respect to the other components in the wellbore by changing some attributes, such as (but not limited to) geometry and material of the component. For example, a component may be made with a larger or smaller thickness and/or made of a plastic, composite, alloy, or other material that is different from other components to help differentiate the signature of the component from other components.

Figure 5:
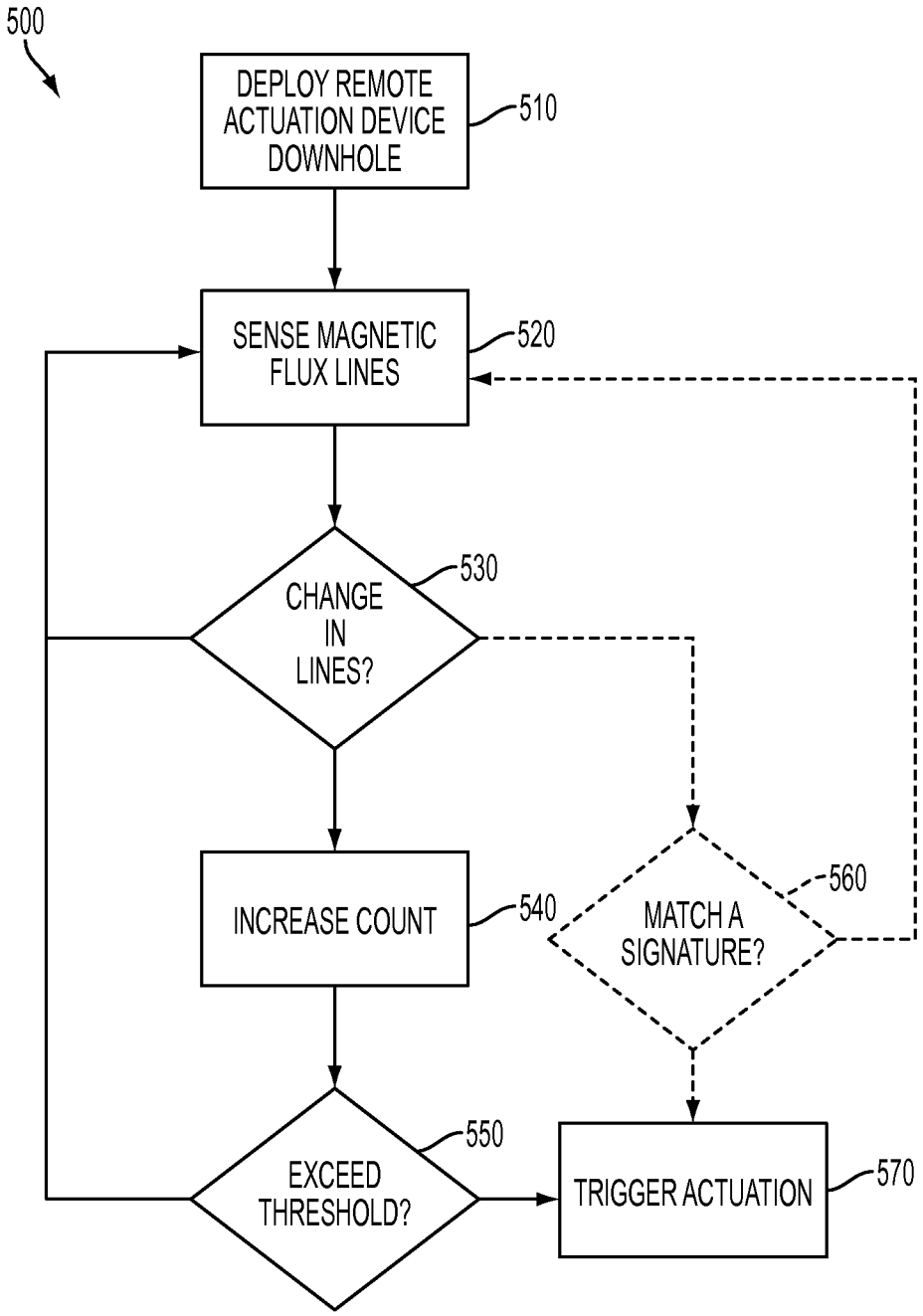
FIG. 5 is a flowchart illustrating an example method of operation for the remote actuation device of FIG. 1.

FIG. 5 is a flowchart illustrating a method 500 of operating the remote actuation device 110 in accordance with an example embodiment. The method 500 includes deploying the remote actuation device downhole (Block 510). As the remote actuation device 110 moves downhole, the magnetic flux lines are sensed (Block 520). A determination is made if there have been changes in the flux lines (Block 530). If there are no changes in the flux lines, then the magnetic flux lines continue to be sensed (Block 520). If there is a change in the flux lines, a count is increased (Block 540). A determination may then be made as to whether a threshold count has been exceeded (Block 550). If a threshold has been exceeded, the actuator is triggered (Block 570). If the threshold has not been exceeded, the magnetic flux lines continue to be sensed (Block 520).

In another embodiment, signatures may be sensed. Specifically, when there is a change in the flux lines (Block 530), the change may be compared against stored signatures to check for a match (Block 560). If there is no match, the magnetic flux lines continue to be sensed (Block 520). If there is a match, the actuator may be triggered (Block 570).

It should be appreciated that other methods may be implemented in certain embodiments. For example, in some embodiments, a signature may be matched to increase a count and a threshold number of signatures may be matched before triggering the actuator. Further, in some embodiments, a failure to match a signature may result in a triggering event.

Embodiments detailed hereinabove provide a device configured for untethered remote triggering of downhole actuations. Thus, costs associated with more expensive and time consuming interventions may be largely avoided.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. An actuation device for use in a well, the device comprising:

a main body for deployment through the well from a surface of the oilfield; and an inductive measurement device incorporated into the body for triggering an actuation at a location in the well during the deployment based on a change sensed by the inductive measurement device, the inductive measurement device having an operating frequency which is variable, wherein the operating frequency is selected to obtain a desired depth of penetration.

2. The device of claim 1 comprising a plurality of coils, wherein at least one coil is a transmission coil and at least one coil is a receiver coil.

3. The device of claim 2, wherein the transmission coil is a powered coil configured to generate a magnetic field.

4. The device of claim 2 comprising a first receiver coil position on a side of the transmission coil and a second receiver coil position on an opposite side of the transmission coil.

5. The device of claim 2, wherein the inductive measurement device is coupled to a processor configured to determine when changes occur to an electro-magnetic coupling between the plurality of coils.

6. The device of claim 5, wherein changes to the electromagnetic coupling result upon detecting changes in magnetic flux lines, the changes being monitored by increasing a count, wherein the triggering of an actuation occurs upon reaching a threshold count.

7. The device of claim 1, wherein the inductive measurement device is coupled to a processor configured to determine when a signature signal is sensed.

8. The device of claim 7, wherein the triggering of an actuation occurs upon determining that a signature signal is sensed.

9. The device of claim 8, wherein the determination and the triggering occur autonomously.

10. The device of claim 1, wherein the inductive measurement device comprises at least one transmitter and at least one receiver.

11. A system comprising:

a string comprising a passageway; and a device deployable through the passageway comprising:

a transmission coil; and at least one receiver coil, wherein the device identifies a component associated with the string by measuring changes in at least one of an electro-magnetic coupling or inductive coupling between the transmission coil and the at least one receiver coil caused by attributes in the component as the device is deployed through the passageway, wherein a geometry of the component is modified to increase the uniqueness of a signature, and wherein an operating frequency of the device is variable.

12. The system of claim 11, wherein measuring changes in at least one of the electromagnetic coupling or inductance results in the signature being associable with a downhole location.

13. The system of claim 12, wherein the signature is associated with a selected sleeve positioned at a known location.

14. The system of claim 11, wherein device autonomously identifies the component.

15. The system of claim 14, wherein the device autonomously triggers an actuation operation upon identifying the component.

16. The system of claim 11, wherein the device is programmed at the surface and pumped down the passageway.

17. The system of claim 11, wherein the material of the component is modified relative to other components to increase the uniqueness of the signature.

18. The system of claim 11, wherein the operating frequency is selected to prevent sensing of objects and features outside of the string.

19. A method comprising:

deploying an untethered object downhole in a string;

selecting an operating frequency of the untethered object, wherein the operating frequency of the untethered object is variable;

monitoring magnetic flux lines for electro-magnetic or inductive changes experienced by the untethered object;

obtaining a signature based on electro-magnetic or inductive changes;

determining if the signature matches a selected signature; and triggering an actuation of the untethered object if the signature matches the selected signature.

* * * * *